US007201617B2

(12) United States Patent
Okamoto et al.

(10) Patent No.: US 7,201,617 B2
(45) Date of Patent: Apr. 10, 2007

(54) FEMALE TERMINAL

(75) Inventors: Reiki Okamoto, Aichi-ken (JP); Harehide Sasaki, Aichi-ken (JP); Yoshiaki Kato, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 0 days.

(21) Appl. No.: 11/000,087

(22) Filed: Dec. 1, 2004

(65) Prior Publication Data

US 2005/0124231 A1 Jun. 9, 2005

(30) Foreign Application Priority Data

Dec. 3, 2003 (JP) ..... 2003-404582

(51) Int. Cl.
*H01R 13/11* (2006.01)

(52) U.S. Cl. ..... 439/851

(58) Field of Classification Search ..... 439/851, 439/854

See application file for complete search history.

(56) References Cited

U.S. PATENT DOCUMENTS 2,711,524 A * 6/1955 Beaver ..... 439/851
3,963,302 A * 6/1976 Gourley ..... 439/867
4,448,477 A * 5/1984 Gladd et al. ..... 439/851
4,722,704 A * 2/1988 VanDerStuyf et al. ..... 439/851
4,874,338 A * 10/1989 Bakermans ..... 439/851
5,116,266 A * 5/1992 Seymour et al. ..... 439/851
5,326,288 A * 7/1994 Lu et al. ..... 439/851
5,667,413 A * 9/1997 Trafton ..... 439/843
6,010,377 A * 1/2000 Dechelette et al. ..... 439/851
6,254,439 B1 * 7/2001 Endo et al. ..... 439/843
6,296,519 B1 * 10/2001 Hashizawa et al. ..... 439/607
6,358,104 B2 * 3/2002 Daugherty et al. ..... 439/851
6,520,998 B1 * 2/2003 Scholler et al. ..... 439/851
6,869,321 B1 * 3/2005 Ashby et al. ..... 439/851

* cited by examiner

*Primary Examiner*—Gary F. Paumen
(74) *Attorney, Agent, or Firm*—Roberts, Mlotkowski & Hobbes, P.C.; Thomas W. Cole

(57) ABSTRACT

A female terminal, into which a male terminal is inserted and connected, is formed in a shape of a substantially square tube. Respective one portions, in an axial direction and between corner portions, of a ceiling wall, a floor wall, and a pair of left and right side walls, which are four wall portions, are plate spring portions which contact the male terminal while elastically deforming independently of one another. Because the wall portions themselves structure the plate spring portions, there is no need to provide a plate spring within a tube wall, and the female terminal can be made compact. Further, contact pressure is ensured because the respective plate spring portions contact the male terminal from different directions.

7 Claims, 7 Drawing Sheets

FEMALE TERMINAL

CROSS-REFERENCE TO RELATED APPLICATION

This application claims priority under 35 USC 119 from Japanese Patent Application No. 2003-404582, the disclosure of which is incorporated by reference herein.

BACKGROUND OF THE INVENTION

1. Field of the Invention

The present invention relates to a female terminal which is attached to, for example, a connector housing, and in which a male terminal or the like of a partner connector housing is inserted and connected.

2. Description of the Related Art

Connectors are known which are structured such that a female terminal is attached within the terminal hole of a connector housing. The female terminal is tubular. A male terminal attached to a partner connector is inserted in the female terminal, and is connected thereto in a conductive state. Such a female terminal will be described on the basis of FIGS. 7A through 7C.

A female terminal 80, which is shown in a perspective view in FIG. 7A, is formed substantially in the shape of a rectangular tube. At the opening end side thereof, a plate piece extending from a floor wall 82 is bent over within the tube wall so as to form a plate spring portion 84. As shown in FIGS. 7B and 7C, a male terminal 86 inserted in the female terminal 80 is nipped between the plate spring portion 84 and contacting walls 90 projecting from a ceiling wall

88, while the male terminal 86 elastically deforms the plate spring portion 84 toward the floor wall 82. Namely, due to the urging force of the plate spring portion 84, the contact pressure (contact load) between the female terminal 80 and the male terminal 86 is ensured. Note that the ceiling wall 88 and the floor wall 82 are connected by a pair of left and right side walls 92.

Accompanying the demand to make connectors, which are applied to vehicles such as automobiles and the like, more compact, the need to make female terminals more compact also has arisen.

However, as described above, in the conventional female terminal 80, the plate spring portion 84 is formed by bending the plate piece over plural times above the floor wall 82. In other words, as shown in FIGS. 7B and 7C, the female terminal 80 is formed as a multilayer structure by the plate spring portion 84 and the floor wall 82 which forms the tube wall, and therefore, it is difficult to make the female terminal 80 more compact.

Further, in order to deform the plate spring portion 84 without interfering with the respective side walls 92, gaps must be provided between the plate spring portion 84 and the respective side walls 92. This also prevents the female terminal 80, from being made more compact. In addition, if the width of the plate spring portion 84 is narrowed in order to make the female terminal more compact along the left-right direction, it is difficult to ensure the contact pressure with the male terminal 86.

SUMMARY OF THE INVENTION

In view of the aforementioned, an object of the present invention is to provide a female terminal which can be made compact while ensuring contact pressure.

In order to achieve the above object, a first aspect of the present invention is a female terminal into which one of a core wire and a male terminal is inserted and connected, wherein the female terminal is formed in a substantially polygonal tube shape, and respective one portions of wall portions along an axial direction are plate spring portions which contact the one of the core and the male terminal while elastically deforming independently of one another.

The female terminal of the first aspect of the present invention is formed in the shape of a substantially polygonal tube. A core wire or a male terminal (hereinafter called "male terminal or the like") is inserted in the female terminal, and connected thereto in a conductive state. At the female terminal, a portion of each flat wall portion between two vertices (corner portions) is a plate spring portion. The respective plate spring portions press-contact the male terminal or the like while elastically deforming independently of one another. For example, when the female terminal is formed in substantially in the shape of a triangular tube, there are three plate spring portions, and when the female terminal is formed in substantially the shape of a hexagonal tube, there are six plate spring portions.

Namely, the wall portions themselves, which form the space into which the male terminal or the like is inserted, structure the plate spring portions. The plate spring portions surround the male terminal or the like, and directly press-contact the male terminal or the like (from different positions in the peripheral direction). Therefore, the female terminal is not a multilayer structure in which a plate spring portion is superposed on a tube wall, as is the case in the conventional art. Further, the wall portions themselves, which form the tube wall into which the male terminal is inserted, structure the plate spring portions. Therefore, there is no need to provide, within the tube wall, a space for ensuring the deformation of the plate spring portions. For these reasons, the female terminal can be made to be compact. In addition, a plurality (three or more) of the plate spring portions, which press-contact the male terminal or the like from respectively different directions, are provided. Therefore, the contact pressure, i.e., the contact load, between the female terminal and the male terminal can be ensured.

In this way, the female terminal of the first aspect of the present invention can be made to be compact, while ensuring the contact pressure.

A female terminal of a second aspect of the present invention has the feature that, in the female terminal of the first aspect, the plate spring portions are long in the axial direction.

In the female terminal of the second aspect, because the plate spring portions are long in the axial direction, it is easy to provide at the respective wall portions the plate spring portions which, although compact, contact (press-contact) the male terminal or the like at appropriate contact pressures.

A female terminal of a third aspect of the present invention has the feature that, in the female terminal of the second aspect, the respective one portions in the axial direction are structured only by the plate spring portions.

In the female terminal of the third aspect, respective regions of predetermined ranges of the end portion or the intermediate portion in the axial direction, are structured only by the plural plate spring portions which press-contact the male terminal or the like while elastically deforming independently of one another. Thus, the widths of the respective plate spring portions in directions perpendicular to the axial (longitudinal) direction, are ensured, and it is easy to obtain a relatively strong contact pressure.

A female terminal of a fourth aspect of the present invention has the feature that, in the female terminal of the second or third aspect, at least one of the plate spring portions is supported at both ends.

In the female terminal of the fourth aspect, at least one of (and preferably, two or more of) the plate spring portions is positioned at an intermediate portion in the axial direction and supported at the both ends. Therefore, the load per unit amount of flexure, i.e., the spring constant, of such a plate spring portion is large as compared with a cantilevered structure in which one axial direction end is a free end. Thus, the contact pressure with respect to the male terminal or the like can be ensured while the amount of deformation (flexure) of the plate spring portion is suppressed. Accordingly, the female terminal can be made to be even more compact while the contact pressure is ensured, or conversely, the contact pressure can be increased without making the female terminal larger.

Further, in order to achieve the above object, a fifth aspect of the present invention is a female terminal comprising: a tube wall into which one of a core wire and a male terminal is inserted; and a plurality of plate spring portions formed to extend from different peripheral positions of an axial direction end portion of the tube wall, the plate spring portions contacting the one of the core and the male terminal while elastically deforming independently of one another.

In the female terminal of the fifth aspect, when a core wire or a male terminal (hereinafter, "male terminal or the like") is inserted into the tube wall, the plate spring portions, which are respectively formed to extend from an axial direction end portion of the tube wall, press-contact the male terminal or the like while elastically deforming independently of one another. In this way, the female terminal is connected to the male terminal or the like in a conductive state.

The respective plate spring portions are formed to extend from an end portion of the tube wall. In other words, the plate spring portions are formed without being superposed on the tube wall. Therefore, the female terminal is not a multilayer structure, as is the case conventionally. Further, because the plate spring portions extend from the end portion of the tube wall into which the male terminal is inserted, there is no need to provide, at the inside of the tube wall, space for ensuring deformation of the plate spring portions. The female terminal can thereby be made compact. In addition, the plate spring portions, which extend from different peripheral direction positions at the end portion of the tube wall, press-contact the male terminal or the like from respectively different directions. Therefore, the contact pressure, i.e., the contact load, between the female terminal and the male terminal can be ensured.

In this way, the female terminal of the fifth aspect of the present invention can be made compact while ensuring contact pressure. Note that the tube wall may be, for example, a substantially polygonal shape as viewed from the axial direction, or may be a substantially circular shape, a substantially oval shape, or the like. Further, for example, a receiving portion, which receives the male terminal or the like from the side opposite the plate spring portions without deforming, may be provided so as to extend from the end portion of the tube wall.

A female terminal of a sixth aspect of the present invention has the feature that, in the female terminal of the fifth aspect, three or more of the plate spring portions are provided.

In the female terminal of the sixth aspect, because three or more of the plate spring portions are provided, the state of connection with the male terminal or the like can be reliably and stably maintained. In particular, it is preferable that the plate spring portions be disposed at uniform intervals in the peripheral direction.

A female terminal of a seventh aspect of the present invention has the feature that the female terminal of the fifth or sixth aspect further comprises a second tube wall to which is connected an end portion, at a side opposite the tube wall, of at least one of the plurality of plate spring portions.

In the female terminal of the seventh aspect, the end portion, at the side opposite the tube wall, of at least one (and preferably, two or more) plate spring portion among the plural plate spring portions extending from the tube wall, is connected to the second tube wall, so that the plate spring portion is supported at both ends. The both ends in the axial direction (the direction of insertion of the male terminal or the like) of such a both-end-supported plate spring portion are supported and are not free ends. Therefore, the load per unit amount of flexure, i.e., the spring constant, is large. As a result, the contact pressure with respect to the male terminal or the like can be ensured, while the amount of deformation (flexure) of each plate spring portion is suppressed. Accordingly, the female terminal can be made to be even more compact while the contact pressure is ensured, or conversely, the contact pressure can be increased without making the female terminal larger. Note that the second tube wall may be structured such that the male terminal or the like is inserted therein, or such that the male terminal or the like is not inserted therein.

A female terminal of an eighth aspect of the present invention has the feature that, in the female terminal of any of the second through seventh aspects, the female terminal is structured by bending, in a tube shape, a substantially flat-plate-shaped member having a plurality of parallel slits, such that longitudinal directions of the slits coincide with the axial direction.

The female terminal of the eighth aspect is structured by bending, in a tube shape, a flat plate in which a plurality of slits are formed in parallel. At the time of this bending process, the longitudinal directions of the respective slits are made to coincide with the axial direction of the female terminal (the tube-shaped member) after the bending. Thus, the portions remaining between the slits after cutting away are the plate spring portions. In this way, it is easy to obtain the female terminal having plural plate spring portions which are structured by the wall portions themselves and which are formed to extend from an end portion of the tube wall.

In particular, in a structure having the plate spring portion whose both axial direction ends are supported, one region in the axial direction of the female terminal, in which the plate spring portions are curved with respect to the axial direction, is structured only by the plate spring portion. In this way, in that region, there is no portion which constrains the length (no portion which does not deform due to the insertion of the male terminal or the like). Therefore, the female terminal can be easily structured by bending the substantially flat-plate-shaped member. Note that, when the plate spring portions are curved with respect to the longitudinal direction, it is preferable to curve them before the bending process.

A female terminal of a ninth aspect of the present invention has the feature that, in the female terminal of the eighth aspect, the female terminal is structured by bending the substantially flat-plate-shaped member into a shape of a substantially square tube.

The female terminal of the ninth aspect of the present invention is formed as a tube which is substantially square as seen from the axial direction. Respective regions, in the longitudinal direction, of the four wall portions, which regions correspond to one another, are the plate spring portions which press-contact the male terminal or the like while elastically deforming independently of one another. Therefore, as compared with a case in which, for example, the female terminal is formed in the shape of a substantially hexagonal tube or the like, it is possible to prevent an increase in the number of bending steps, while the widths of the respective plate spring portions are ensured. On the other hand, as compared with a case in which the female terminal is formed, for example, as a triangular tube, the distance from the axial center to each vertex is small, and the effect of making the female terminal compact is great.

A female terminal of a tenth aspect of the present invention has the feature that, in the female terminal of any of the first through ninth aspects, the plate spring portions are provided so as to, in natural states, protrude toward an axis so as to not jut-out from a region of an outer configuration of the tube wall or from a region of an outer configuration of portions of the wall portions other than the plate spring portions, when viewed from the axial direction in a state in which the one of the core wire and the male terminal is inserted.

In the female terminal of the tenth aspect, in their natural states, the plate spring portions protrude toward the axis with respect to the wall portions or the tube wall. When the male terminal or the like is inserted, the plate spring portions contact the male terminal or the like while elastically deforming in directions of moving away from the axis, so as to not jut-out from the region of the outer configuration of the portions of the wall portions other than the plate spring portions, or from the region of the outer configuration of the tube wall, when viewed from the axial direction. Therefore, there is no need to provide, at the outer side of the region of the outer configuration of the female terminal, space for deformation of the plate spring portions, and there are no constraints on, for example, the connector housing which accommodates and holds the female terminal. Namely, a connector, which is structured such that the present female terminal is accommodated and held in a connector housing, can reliably be made to be compact.

As described above, the female terminal relating to the present invention has the excellent effect that it can be made compact while ensuring contact pressure.

DETAILED DESCRIPTION OF THE INVENTION

Figure 1:
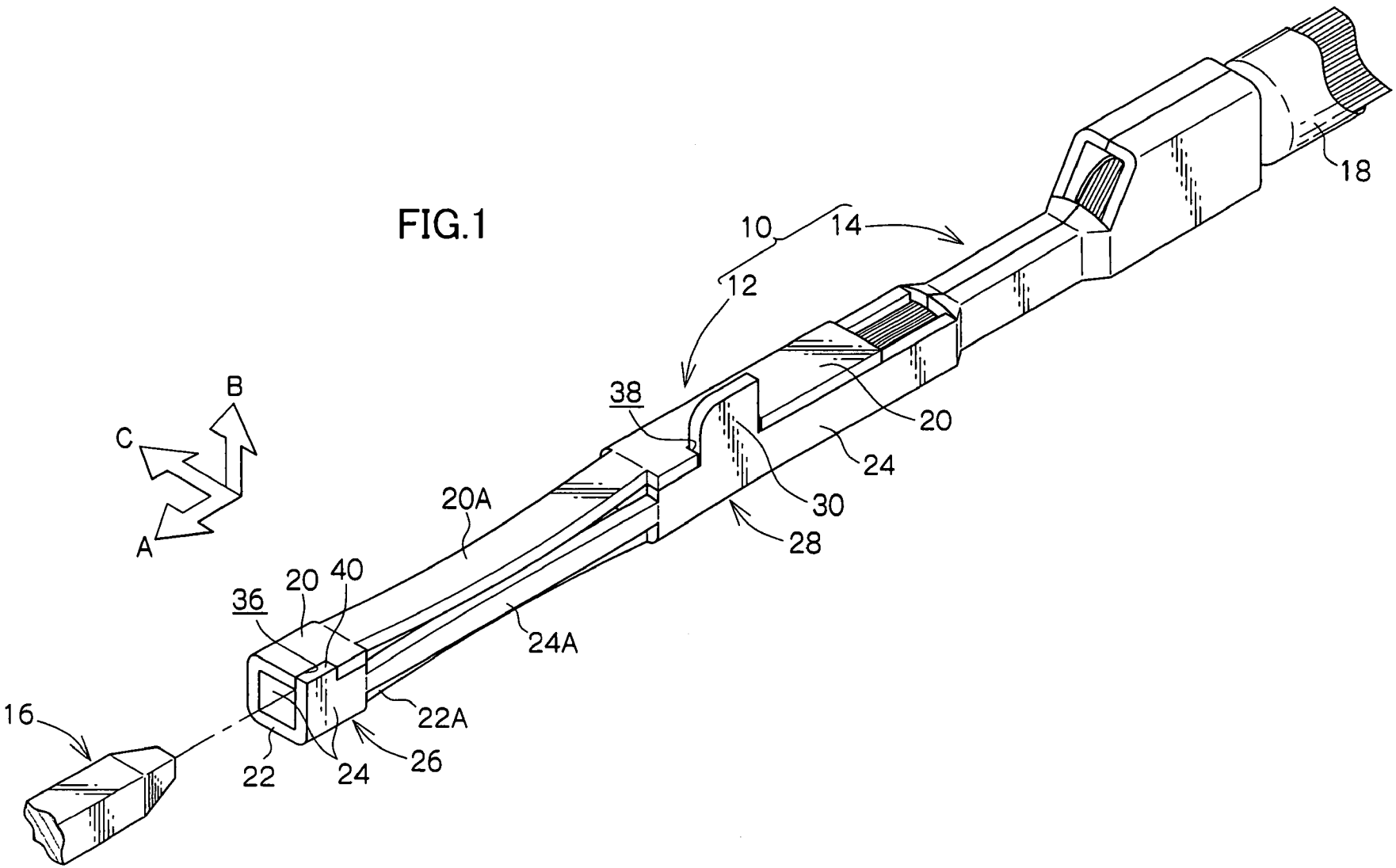
FIG. 1 is a perspective view showing the schematic overall structure of a female terminal relating to an embodiment of the present invention.

A female terminal 10, which serves as the female terminal relating to an embodiment of the present invention, will be described on the basis of FIG. 1 through FIGS. 4A and 4B. For convenience of explanation, in the following description, the direction indicated by arrow A in the drawings is the front side, and the directions indicated in the drawings by arrow B and arrow C, which are perpendicular to arrow A, are the upper side and the right side, respectively.

Figure 2A:
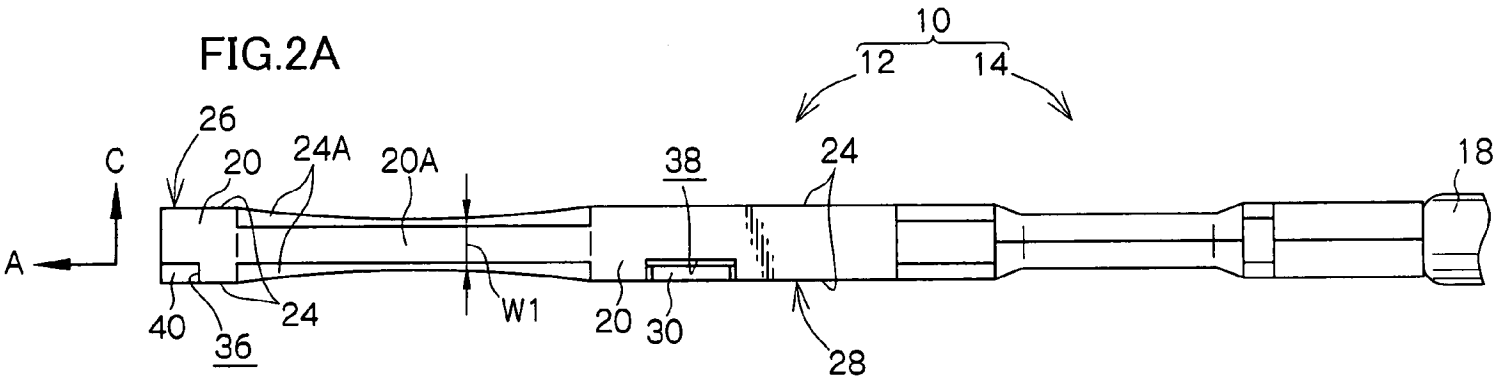
FIG. 2A is a plan view showing the female terminal relating to the embodiment of the present invention.
Figure 2C:
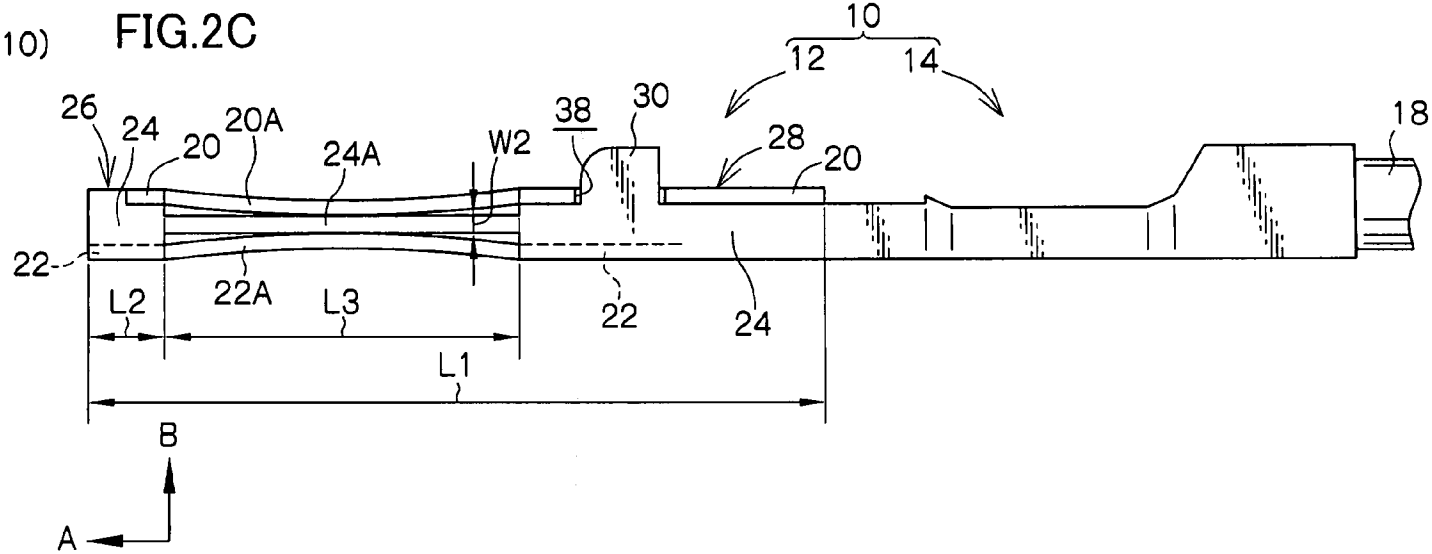
FIG. 2C is a side view showing the female terminal relating to the embodiment of the present invention.
Figure 2B:
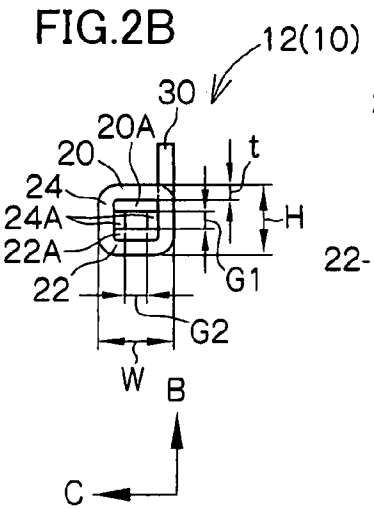
FIG. 2B is a front view showing the female terminal relating to the embodiment of the present invention.

The female terminal 10 is shown in a perspective view in FIG. 1, and is shown in views from three sides in FIGS. 2A through 2C. As shown in these figures, the female terminal 10 has a terminal portion 12, which is formed in the shape of a tube which is substantially square when viewed in the axial direction, and a wire connecting portion 14 connected to the rear of the terminal portion 12. A male terminal 16 is inserted into the terminal portion 12. A wire (conductor) 18 is connected by crimping to the wire connecting portion 14.

As described above, the terminal portion 12 is formed in the shape of a tube which is substantially square when viewed in the axial direction, by a ceiling wall 20, a floor wall 22 opposing the ceiling wall 20, and a pair of left and right side walls 24 which oppose one another. A longitudinal direction portion of each of the ceiling wall 20, the floor wall 22, and the side walls 24, which form the terminal portion 12, are plate spring portions 20A, 22A, 24A, respectively. Specifically, at the respective corner portions between the side walls 24 and the ceiling wall 20, and the side walls 24 and the floor wall 22 (i.e., at the vertices of the square), portions, in the longitudinal direction, which correspond to one another are cut-off, and the remaining portions of the ceiling wall 20, the floor wall 22, and the side walls 24, which portions are between these cut-off portions (the corner portions), are the plate spring portions 20A, 22A, 24A, respectively.

The proximal ends of the plate spring portions 20A, 22A, 24A are set slightly more toward the rear than the front end of the terminal portion 12 (the female terminal 10), and the respective positions thereof in the longitudinal direction coincide. The lengths of the plate spring portions 20A, 22A, 24A, i.e., the positions in the longitudinal direction of the respective final ends of the plate spring portions 20A, 22A, 24A, coincide. The respective final ends of the plate spring portions 20A, 22A, 24A are positioned sufficiently forward of the rear end of the terminal portion 12.

In this way, a front tube portion 26, which is positioned at the front side of the plate spring portions 20A, 22A, 24A and supports the front ends thereof, and a rear tube portion 28, which is positioned at the rear side of the plate spring portions 20A, 22A, 24A and supports the rear ends thereof, are formed at the terminal portion 12. Accordingly, each of the plate spring portions 20A, 22A, 24A is a structure supported at the both ends thereof. Namely, it can be considered that plate spring portions 20A, 22A, 24A are formed to extend from the axial direction end portions of the front tube portion 26 and the rear tube portion 28. In the present embodiment, as shown in FIG. 2C, an overall length L1 of the terminal portion 12 is substantially 7.5 mm, a length L2 of the front tube portion 26 is substantially 0.75 mm, and lengths L3 (lengths along the longitudinal direction) of the plate spring portions 20A, 22A, 24A are each substantially 3.6 mm.

In their natural states, the plate spring portions 20A, 22A, 24A are curved, with respect to the longitudinal direction, so as to protrude toward the interior of the terminal portion 12. Specifically, the plate spring portions 20A, 22A, 24A curve smoothly with respect to the longitudinal direction, such that the amounts of inward protrusion thereof are greatest at the longitudinal direction central portions thereof. An opposing interval G1 between the plate spring portions 20A, 22A in their natural states is slightly smaller than the vertical direction height of the male terminal 16. An opposing interval G2 between the pair of plate spring portions 24A is slightly smaller than the left-right direction width of the male terminal 16.

Figure 4A:
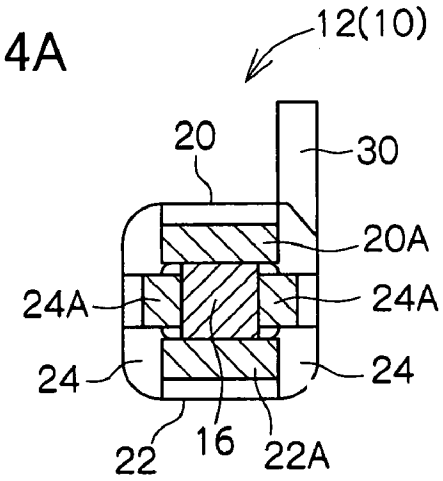
FIG. 4A is a sectional view perpendicular to an axis, showing a connected state of the female terminal relating to the embodiment of the present invention, with a male terminal.

The opposing interval between the plate spring portions 20A, 22A, and the opposing interval between the pair of plate spring portions 24A, are set so as to be substantially equal. Namely, as shown in FIG. 4A, the outer shape of the male terminal 16 is substantially square as seen in the axial direction. Note that, in the present embodiment, as shown in FIG. 2B, a vertical direction height H and a left-right direction width W of the terminal portion 12 are each substantially 0.75 mm, and a thickness t of each of the ceiling wall 20, the floor wall 22, and the side walls 24 (i.e., each of the plate spring portions 20A, 22A, 24A) is substantially 0.15 mm, whereas the opposing interval G1 between the plate spring portions 20A, 22A and the opposing interval G2 between the pair of plate spring portions 24A are each substantially 0.23 mm.

When the male terminal 16 is inserted into the terminal portion 12, the plate spring portions 20A, 22A, 24A contact (press-contact) the male terminal 16 while flexing elastically toward the outer sides. Namely, the terminal portion 12 of the female terminal 10 holds the male terminal 16 in a conductive state, by the press-contact forces (the contact loads) based on the restoring forces of the plate spring portions 20A, 22A, 24A. Due to the plate spring portions 20A, 22A, 24A flexing elastically toward the outer sides as they contact the male terminal 16, there is no need to ensure space for deformation within the terminal portion 12.

Figure 4B:
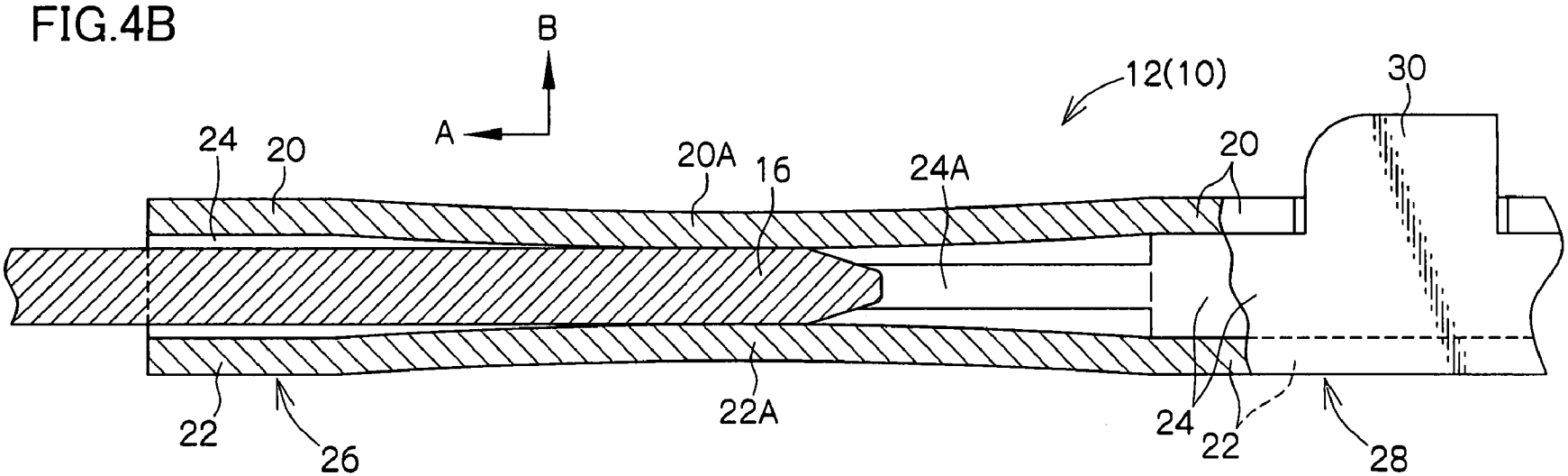
FIG. 4B is a side sectional view showing the connected state of the female terminal relating to the embodiment of the present invention, with the male terminal.

As shown in FIG. 4B, the male terminal 16 is inserted-in deeper than the longitudinal direction central portions of the plate spring portions 20A, 22A, 24A (i.e., such that the distal end of the male terminal 16 is positioned further rearward than the longitudinal direction central portions of the plate spring portions 20A, 22A, 24A). As shown in FIG. 4A, the plate spring portions 20A, 22A, 24A, which respectively curve toward the inner side of the terminal portion 12 as described above, do not have any portions which jut out further than the region of the outer configuration of the front tube portion 26 (the rear tube portion 28) as seen in the axial direction in the state in which the male terminal 16 is inserted in.

At the terminal portion 12, a left-right direction width w1 of each of the plate spring portions 20A, 22A, which press-contact the male terminal 16 from above and below, is larger than a vertical direction width w2 of each of the plate spring portions 24A which press-contact the male terminal 16 from the left and right. Therefore, at the terminal portion 12, the vertical direction holding force which holds the male terminal 16 is greater than the left-right direction holding force. In this way, at the female terminal 10, the plate spring portions 20A, 22A function as main springs which mainly maintain the state of holding the male terminal 16, whereas the plate spring portions 24A function as auxiliary springs which suppress joggling of the male terminal 16 in the left-right direction. Note that, in the present embodiment, as shown in FIGS. 2A and 2C, the left-right direction width w1 of each of the plate spring portions 20A, 22A is substantially 0.4 mm, whereas the vertical direction width w2 of each of the plate spring portions 24A is substantially 0.2 mm.

As described above, the ceiling wall 20, the floor wall 22, and the side walls 24 respectively correspond to the "wall portions" in the present invention. Either one of the front tube portion 26 and the rear tube portion 28 corresponds to the "tube wall" in the present invention, and the other corresponds to the "second tube wall" in the present invention. Moreover, as described above, the female terminal 10 corresponds to the "female terminal" in the present invention, but in a narrow sense, the terminal portion 12 can be considered as the "female terminal" in the present invention.

The female terminal 10 is inserted and held in, for example, the terminal hole of an unillustrated connector housing, so as to structure a connector. The male terminal 16, which is held in a partner connector of that connector, is inserted in and connected thereto. The terminal hole is a substantially square hole which substantially corresponds to the outer configuration of the female terminal 10 (the terminal portion 12), and contacts the outer surfaces of the ceiling wall 20, the floor wall 22, and the side walls 24, except for the plate spring portions 20A, 22A, 24A. In this way, it is possible to reliably realize a structure in which deformation of the front tube portion 26 and the rear tube portion 28 accompanying the insertion of the male terminal 16 (i.e., accompanying the deformation of the plate spring portions 20A, 22A, 24A) is limited, and the plate spring portions 20A, 22A, 24A are able to deform independently of one another and are structures which are supported at the both ends thereof. Note that, in order to prevent incorrect insertion of the connector housing into the terminal hole, a stabilizer 30 is provided at the rear portion of the terminal portion 12. In the present embodiment, the stabilizer 30 is structured as a projecting piece which projects upwardly along the left-side side wall 24.

When the female terminal 10, which is inserted and held in the connector housing, is installed in a traveling vehicle such as, for example, an automobile or the like, it is preferable to dispose the female terminal 10 such that the outer surface of the ceiling wall 20 is directed toward the top side (or toward the bottom side). In this case, the female terminal 10 functions so as to hold the male terminal 16 by the top and bottom plate spring portions 20A, 22A, and so as to suppress (absorb) horizontal direction vibrations by the left and right plate spring portions 24A.

The respective portions of the above-described female terminal 10 are formed integrally by press working. Specifically, as shown in expanded views in FIGS. 3A and 3B, the female terminal 10 is structured by bending a terminal plate 32 substantially perpendicularly along three bending lines BL, which are parallel to one another and are shown by the dashed lines. Note that the reference numerals in parentheses in FIGS. 3A and 3B correspond to the structural portions of the female terminal 10 of those reference numerals. When, in the following explanation, the structural portions of the terminal plate 32 are described by using the reference numerals in parentheses, the names of the corresponding structural portions at the female terminal 10 will be used.

Figure 3A:
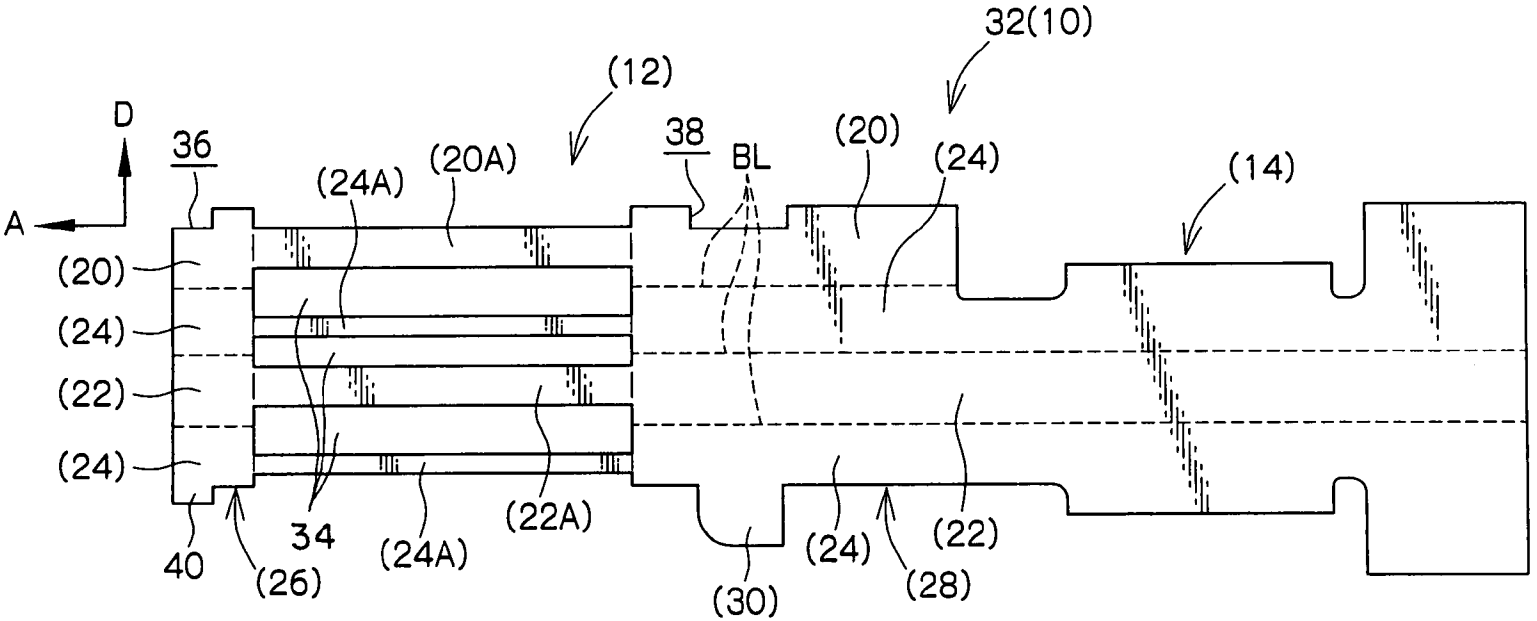
FIG. 3A is an expanded view showing a state before assembly of the female terminal relating to the embodiment of the present invention.

The terminal plate 32 is formed in the shape of a flat plate. The direction D side end portion shown in FIG. 3A is the end portion of the ceiling wall 20 (the left end portion after assembly), and the end portion at the side opposite the direction of arrow D is the end portion of the left-side side wall 24 (the top end portion after assembly). Slits 34, which are cut-out (removed) in substantially rectangular shapes whose longitudinal directions are the front-back direction, are provided in a vicinity of the front end of the terminal plate 32 so as to straddle the bending lines BL. The portions remaining after the cutting-out of the slits 34 structure the plate spring portions 20A, 22A, 24A.

Figure 3B:
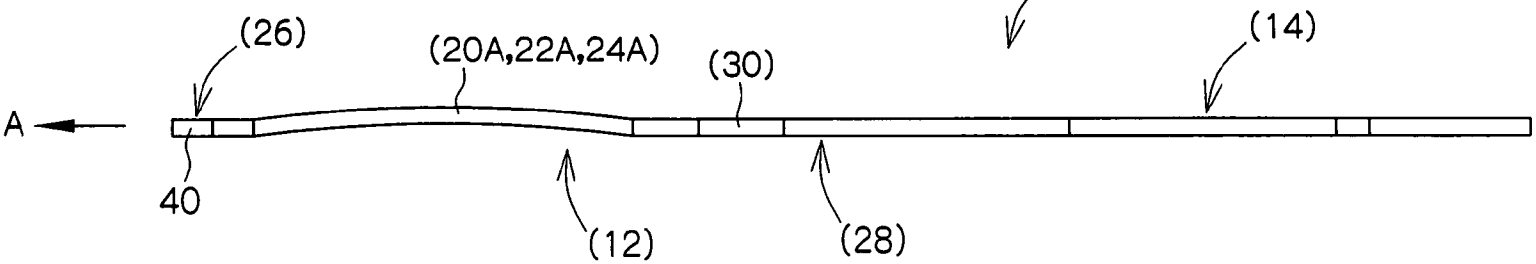
FIG. 3B is a side view showing the state before assembly of the female terminal relating to the embodiment of the present invention.

As shown in FIG. 1, the left end portion of the ceiling wall 20 basically abuts the top end surface of the left-side side wall 24. However, at the front end portion of the terminal portion 12 (the front tube portion 26) and at the extending portion of the stabilizer 30, the top end portion of the left-side side wall 24 abuts the left end surface of the ceiling wall 20. In correspondence therewith, at the terminal plate 32, as shown in FIGS. 3A and 3B, concave portions 36, 38, which are formed by cutting-off portions of the ceiling wall 20, are formed, and a convex portion 40 is made to extend from the left-side side wall 24. Namely, as shown in FIG. 1, in the state in which the female terminal 10 is assembled, the convex portion 40 is fit into the concave portion 36, and the root portion of the stabilizer 30 is fit into the concave portion 38.

Although not illustrated, in the state in which the terminal plate 32 is bent along the bending lines BL, the wire connecting portion 14 is formed in the shape of a groove which opens upwardly. By caulking the wire connecting portion 14 with a wire 18 set therein, the wire 18 is connected to the wire connecting portion 14 in a crimped state, as shown in FIGS. 1, 2A and 2C.

Next, operation of the present embodiment will be described.

In the female terminal 10 having the above-described structure, the male terminal 16 is inserted into the terminal portion 12 from the front side shown by arrow A, and is connected in a conductive state. Namely, the female terminal 10 holds the male terminal 16 due to the plate spring portions 20A, 22A, 24A, while elastically deforming, press-contacting the male terminal 16 from respectively different directions and by press-contact forces which are based on the restoring forces.

Here, the plate spring portions 20A, 22A, 24A, which generate the press-contact forces (contact loads) for holding the male terminal 16, are structured by the ceiling wall 20, the floor wall 22, and the side walls 24 themselves, which structure the tube wall of the terminal portion 12. Or, from another standpoint, the plate spring portions 20A, 22A, 24A are formed to extend from the end surface of the front tube portion 26 (or the rear tube portion 28). Therefore, the terminal portion 12 is not a multilayer structure due to a plate spring portion being bent over above the floor wall as is the case in the conventional art. Further, the ceiling wall 20, the floor wall 22, and the sides walls 24 themselves, which structure the tube wall into which the male terminal 16 is inserted, structure the plate spring portions 20A, 22A, 24A. Or, from another standpoint, the plate spring portions 20A, 22A, 24A are provided at regions other than the tube wall, between the front tube portion 26 and the rear tube portion 28. Therefore, there is no need to provide, at the inner side of the terminal portion 12, gaps for ensuring deformation of the plate spring portions 20A, 22A, 24A. For these reasons, the female terminal 10 can be made more compact. In particular, in their natural states, the plate spring portions 20A, 22A, 24A curve toward the inner side of the terminal portion 12. Even in the state shown in FIG. 4A in which the male terminal 16 is connected, the plate spring portions 20A, 22A, 24A do not jut out from the region of the outer configuration of the front tube portion 28. Therefore, there is no need for space for deformation at the outer side of this region of the outer configuration. As a result, the connector housing, i.e., the connector, in which the female terminal 10 is accommodated and held can reliably be made compact.

The plate spring portions 20A, 22A press-contact the male terminal 16 from the vertical directions, and the pair of left and right plate spring portions 24A press-contact the male terminal 16 from the left and right directions. In other words, the male terminal 16 is press-contacted from four different directions (directions of two axes). Therefore, the contact pressure of the female terminal 10 with respect to the male terminal 16 can be ensured, while the female terminal 10 can be made compact. Further, the region between the front tube portion 26 and the rear tube portion 28 at the terminal portion 12 is structured only by the plate spring portions 20A, 22A, 24A. Therefore, the widths w 1, w2 of the plate spring portions 20A, 22A, 24A, which are structured by the ceiling wall 20, the floor wall 22, and the side walls 24 themselves, can be ensured. Thus, it is easy to ensure the press-contact while maintaining a compact structure.

In particular, the plate spring portions 20A, 22A, 24A are each a structure which is supported at the both ends thereof. Thus, as compared with cantilevered structures, the spring constants of the plate spring portions 20A, 22A, 24A are large. Therefore, while the amount of deformation (flexure) of the plate spring portions 20A, 22A, 24A is suppressed, the contact pressure with respect to the male terminal 16 can be ensured. The female terminal 10 can be made to be even more compact while the contact pressure is ensured, or conversely, the contact pressure can be increased without making the female terminal 10 larger.

In this way, the female terminal 10 relating to the present embodiment can be made to be compact while the contact pressure with respect to the male terminal 16 is ensured.

At the female terminal 10, the plate spring portions 20A, 22A, 24A are all long along the axial direction. Therefore, while the female terminal 10 is compact, it is easy to obtain the plate spring portions 20A, 22A, 24A which contact the male terminal 16 at respectively appropriate contact pressures. Namely, making the plate spring portions, which are formed by the ceiling wall 20, the floor wall 22, and the side walls 24 themselves, long in, for example, the direction perpendicular to the axial direction, would be difficult from the standpoints of providing the plate spring portions at the terminal portion 12 having the above-described dimensions (both width W and height H less than or equal to 1 mm), and of setting the appropriate contact pressures. However, because the plate spring portions 20A, 22A, 24A are long along the axial direction, they can be provided so as to contact the male terminal 16 easily and at the appropriate contact pressures.

Moreover, the region of the terminal portion 12 between the front tube portion 26 and the rear tube portion 28 is structured only by the plate spring portions 20A, 22A, 24A. In other words, by providing the respective plate spring portions at all of the wall portions surrounding the male terminal 16, there is no wall portion whose length is constrained. Therefore, by bending the terminal plate 32, it is possible to obtain the female terminal 10 having the plate spring portions 20A, 22A, 24A which are each a both-end-supported structure. Namely, the plate spring portions 20A, 22A, 24A at the terminal plate 32 in the expanded state shown in FIG. 3A are curved as shown in FIG. 3B, and the terminal plate 32 after this curving is bent over substantially perpendicularly at the bending lines BL. The female terminal 10 can thereby be easily obtained. Further, the female terminal 10 which is formed by bending the terminal plate 32 can be manufactured extremely easily, as compared with a method of forming cut-outs directly at the corner portions of a square tube-shaped member, or a method of forming a female terminal by integral molding. Namely, it is easy to manufacture the female terminal 10.

In particular, because the plate spring portions 20A, 22A, 24A can be formed at the same time as the punching of the terminal plate 32, the terminal portion 12 can be formed merely by the bending lines BL being bendable. The number of steps in the bending process can be reduced as compared with a structure in which the plate spring portion 84 is formed by bending a plate piece over several times above the floor wall 82 as in the conventional art. Namely, the female terminal 10 can be manufactured easily as compared with the conventional female terminal 80.

The terminal portion 12 is formed in the shape of a square tube which is substantially square as seen in the axial direction, and the plate spring portions 20A, 22A, 24A are provided at the respective sides thereof (the ceiling wall 20, the floor wall 22, and the side walls 24). Therefore, as compared with a case in which the terminal portion is formed, for example, in the shape of a substantially hexagonal tube or the like, the widths w 1 of the plate spring portions 20A, 22A and the widths of the plate spring portions 24A can be ensured, and an increase in the number of steps of bending the terminal plate 32 at the bending lines BL is prevented. On the other hand, as compared with a case in which the terminal portion is formed, for example, in the shape of a triangular tube, in the terminal portion 12 which is square as seen in the axial direction, the distance from the axial center to each vertex is small, and the effect of making the structure compact is great.

In the female terminal 10, the male terminal 16 is held by sufficient contact pressures by the top and bottom plate spring portions 20A, 22A, and in addition, the left and right plate spring portions 24A press-contact the male terminal 16. Therefore, lateral direction vibrations, which were not considered in the conventional art, are suppressed, and the reliability of contact with the male terminal 16 is improved.

In the above-described embodiment, the top and bottom plate spring portions 20A, 22A are formed so as to be wider than the left and right plate spring portions 24A. However, the present invention is not limited to the same, and, for example, the structure relating to the modified example shown in FIGS. 5A through 5C may be used. This modified example will be described hereinafter, but parts and portions thereof which are basically the same as those of the above-described embodiment are denoted by the same reference numerals as in the above-described embodiment, and description thereof is omitted.

Figure 5A:
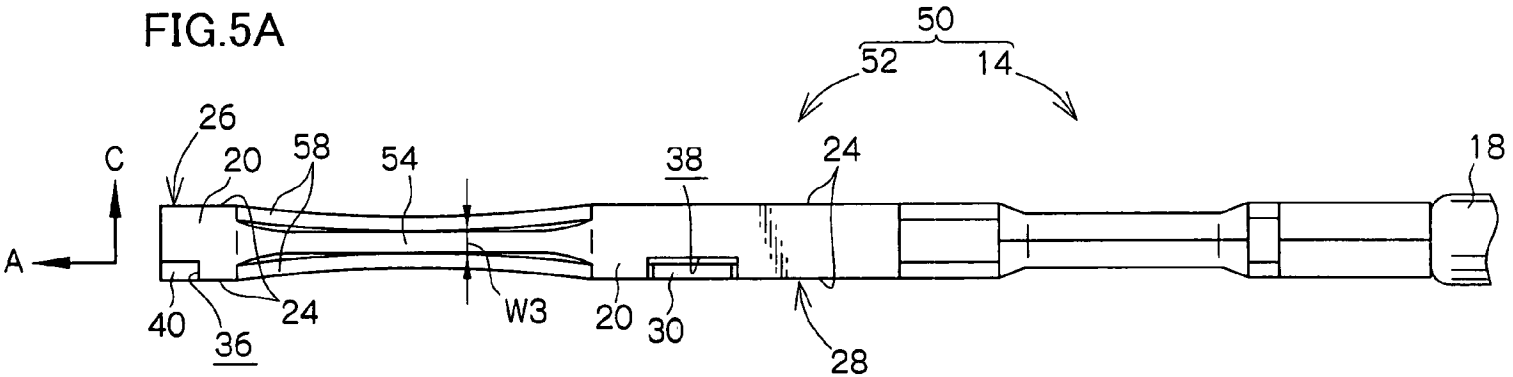
FIG. 5A is a plan view showing a modified example of the female terminal relating to the embodiment of the present invention.
Figure 5C:
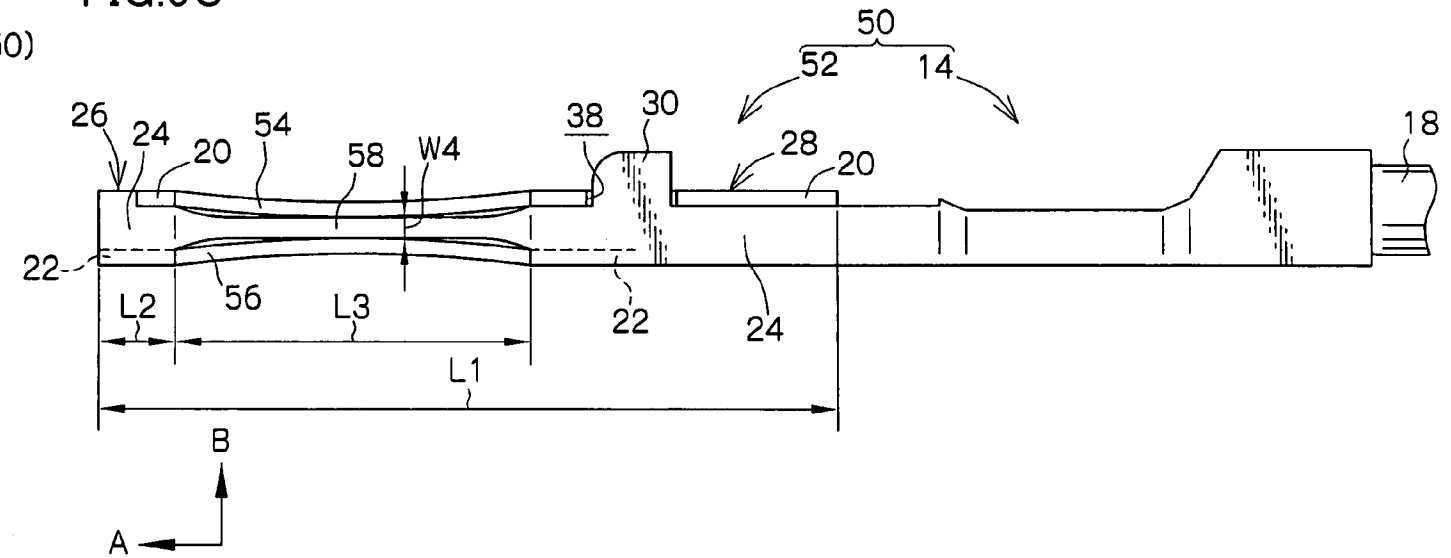
FIG. 5C is a side view showing the modified example of the female terminal relating to the embodiment of the present invention.
Figure 5B:
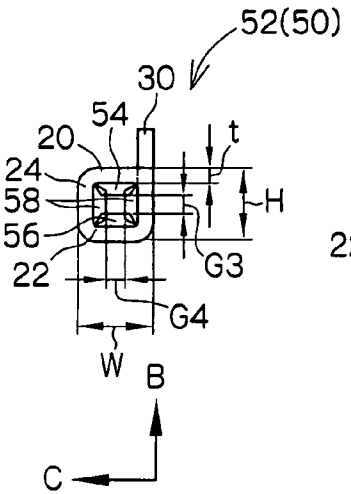
FIG. 5B is a front view showing the modified example of the female terminal relating to the embodiment of the present invention.

A female terminal 50 shown in FIGS. 5A, 5B and 5C is structured to have a terminal portion 52 instead of the terminal portion 12. The terminal portion 52 has plate spring portions 54, 56, 58 instead of the plate spring portions 20A, 22A, 24A. The plate spring portions 54, 56, 58 are similar to the plate spring portions 20A, 22A, 24A relating to the above-described embodiment with regard to the fact that they are structured by longitudinal direction portions of the ceiling wall 20, the floor wall 22, and the pair of side walls 24, respectively. However, the plate spring portions 54, 56, 58 differ from the plate spring portions 20A, 22A, 24A with regard to the fact that the respective widths of the plate spring portions 54, 56, 58 coincide. Moreover, both longitudinal direction end portions of each of the plate spring portions 54, 56, 58 are formed in tapered shapes which continuously become wider. In addition, in the present modified example, left-right widths w3 of the plate spring portions 54, 56 at the longitudinal direction central portions thereof, and top-bottom widths w4 of the pair of the plate spring portions 58 at the longitudinal direction central portions thereof, are each substantially 0.2 mm.

At the female terminal 50, an opposing interval G3 between the plate spring portions 54, 56 in their natural states is equal to an opposing interval G4 between the pair of plate spring portions 58 in their natural states. However, these opposing intervals G3, G4 are slightly smaller than the opposing intervals G1, G2 in the above-described embodiment. Namely, the amounts of deformation of the respective plate spring portions 54, 56, 58 when the male terminal 16 of the same dimensions as in the above-described embodiment is inserted in, are slightly greater than those in the above-described embodiment. In the present modified example, the opposing intervals G3, G4 are each substantially 0.22 mm. In this way, the contact pressure with respect to the male terminal 16 is ensured in a structure in which the top and bottom plate spring portions 54, 56 are made to be narrower (are made to have lower spring constants than) the spring plate portions 20A, 22A as described above.

Figure 6A:
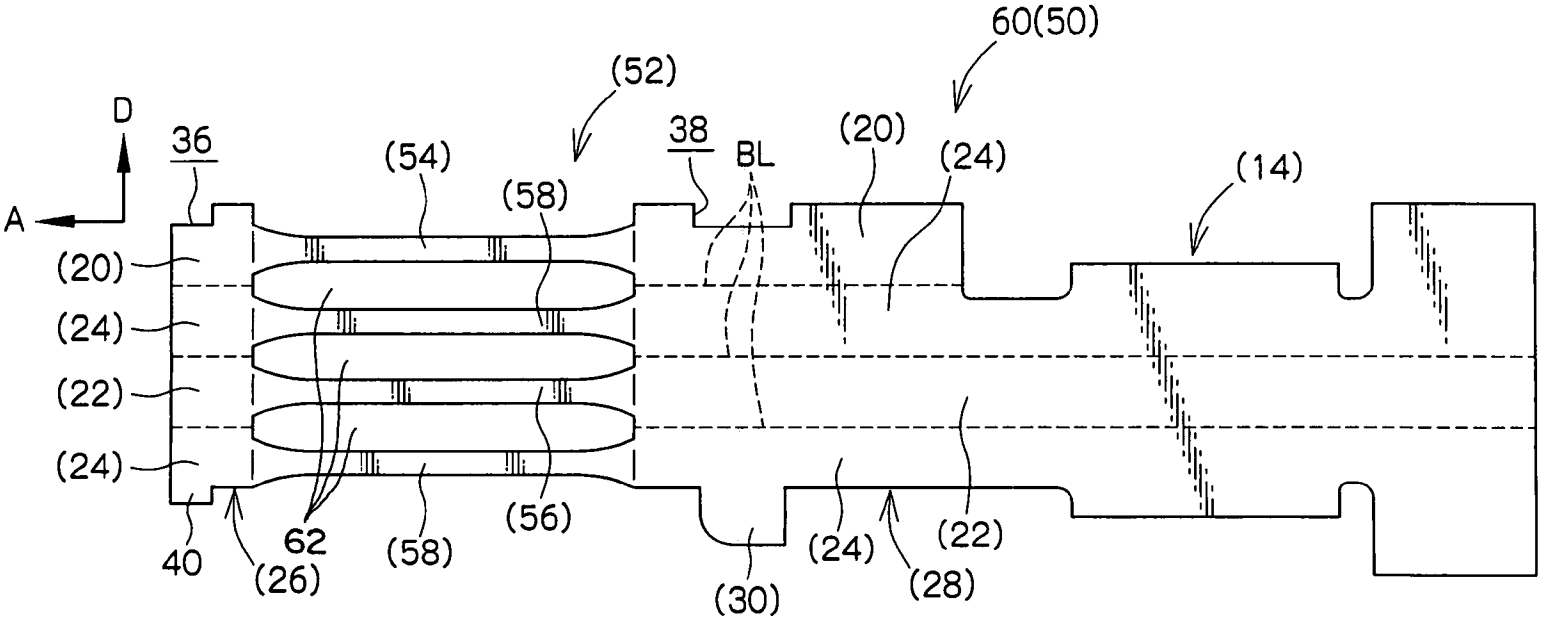
FIG. 6A is an expanded view showing a state before assembly of the modified example of the female terminal relating to the embodiment of the present invention.
Figure 6B:
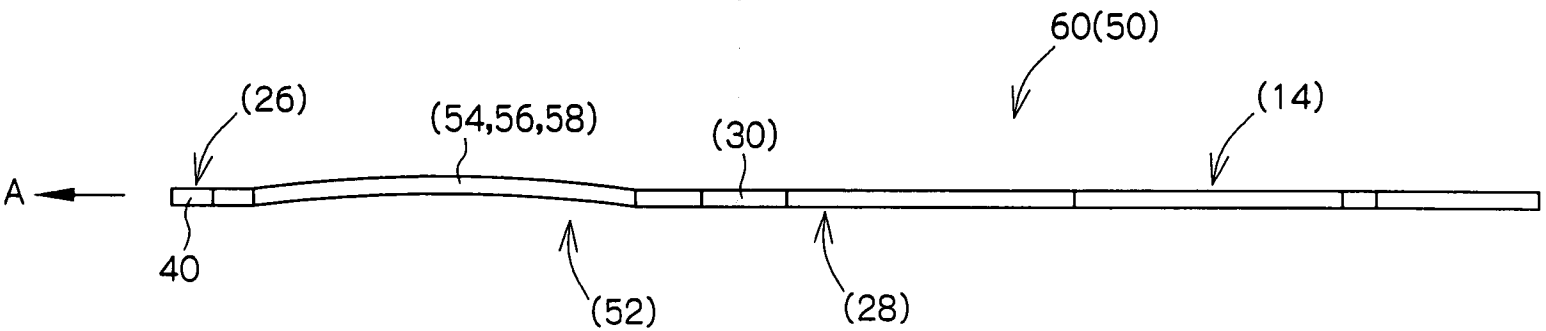
FIG. 6B is a side view showing the state before assembly of the modified example of the female terminal relating to the embodiment of the present invention.
Figure 7A:
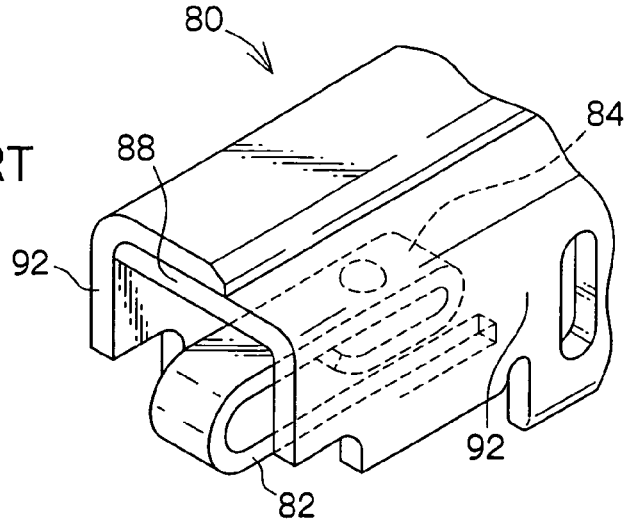
FIG.7A PRIOR ART
FIG. 7A is a perspective view showing a conventional female terminal.
Figure 7B:
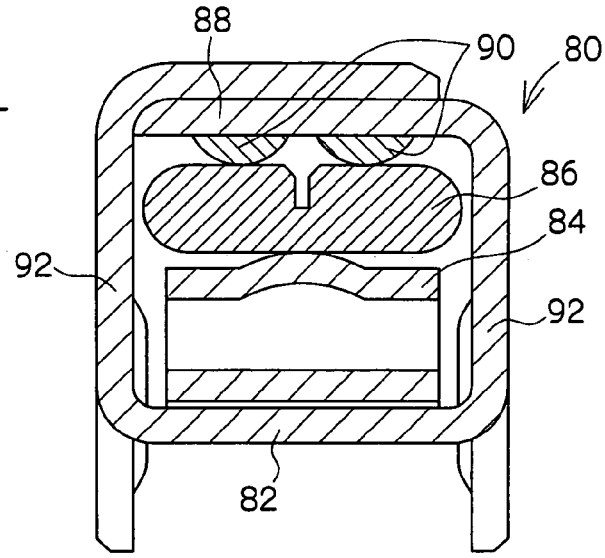
FIG.7B PRIOR ART
FIG. 7B is a sectional view perpendicular to an axis, showing the conventional female terminal.
Figure 7C:
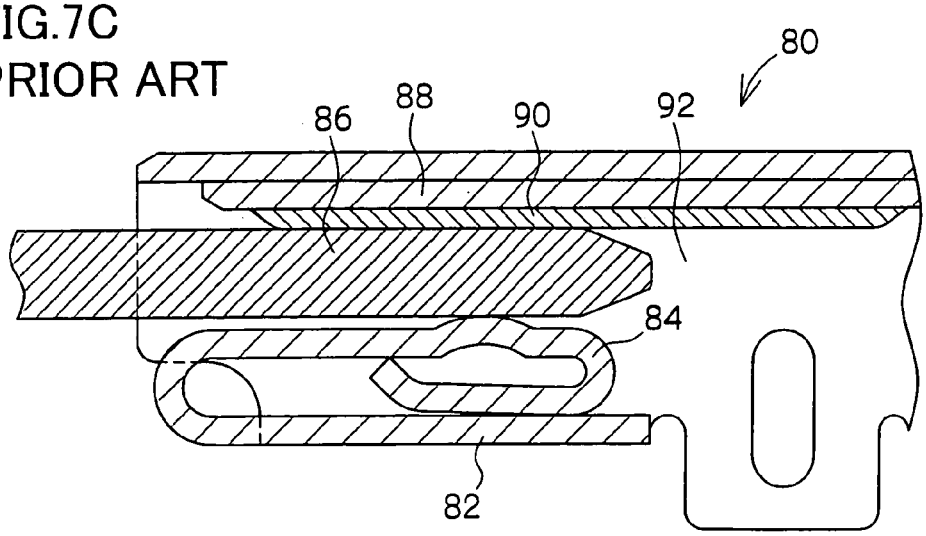
FIG.7C PRIOR ART
FIG. 7C is a side sectional view showing the conventional female terminal.

The female terminal 50 is structured by substantially perpendicularly bending the bending lines BL of a terminal plate 60 shown in FIGS. 6A and 6B. The plate spring portions 54, 56, 58 are structured by portions remaining after cutting-out slits 62, which are cut out in substantially rectangular shapes which are long along the front-back direction, and straddle the bending lines BL at the terminal plate 60. By forming the slits 62 such that the both longitudinal direction end portions of each of the slits 62 narrow, the both longitudinal direction end portions of the plate spring portions 54, 56, 58 are formed so as to become continuously wider.

Also in accordance with the female terminal 50 relating to the present modified example, effects similar to those of the above-described embodiment can be obtained. Further, the plate spring portions 54, 56, 58 of the female terminal 50 have the same widths, and there is no main spring/auxiliary spring relationship from the standpoint of the magnitudes of the contact pressures. However, because the plate spring portions 54, 56, 58 press-contact the male terminal 16 from respectively different directions, they function to suppress (absorb) vibrations and improve the reliability of contacting the male terminal 16.

The above-described embodiment and modified example are preferable structures in which the female terminals 10, 50 are formed as substantially square tubes. However, the present invention is not limited to the same, and the female terminals 10, 50 may be formed in the shape of a polygonal tube as seen from the axial direction, such as substantially rectangular, substantially triangular, or substantially hexagonal, or may be formed as a substantially circular tube or a substantially oval tube. For example, the female terminal 10 or the like which is shaped as a circular tube can be formed by curving (rolling), not bending) the terminal plate 32, 60 along the bending lines BL. Further, it is preferable that the female terminal 10 or the like which is shaped as a circular tube have three or more of the plate spring portions 20A and the like, but may be structured to have two of the plate spring portions 20A and the like. In this case, for example, it is preferable for the press-contact directions of the two plate spring portions 20A or the like to be intersecting directions, and to provide a receiving portion which has a cantilevered structure and receives, without hardly deforming at all, the male terminal 16 which is press-contacted by the respective plate spring portions 20A.

Moreover, the above-described embodiment and modified example are preferable structures in which each of the plate spring portions 20A, 22A, 24A or the like are both-end-supported structures. However, the present invention is not limited to the same, and, for example, all or some of the plate spring portions 20A, 22A, 24A may be structured so as to be supported at one end. Further, for example, in a structure having only the spring plate portion 20A or the like which is supported at one end, it suffices to not provide the front tube portion 26, or to provide a connecting portion which connects the front tube portion 26 and the rear tube portion 28 and does not deform as the male terminal 16 is inserted in.

Further, the above-described embodiment and modified example are preferable structures in which the plate spring portions 20A, 22A, 24A or the like are formed by cutting-off the corner portions between the ceiling wall 20, the floor wall 22, and the pair of side walls 24 (the vertices of the polygon, i.e., the portions at the terminal plates 32, 60 which portions straddle the bending lines BL). However, the present invention is not limited to the same. For example, in a relatively large female terminal 10 or the like, it suffices to use, as the plate spring portion, a region between a pair of cut-away portions formed by cutting off two longitudinal direction portions of the ceiling wall 20 in a direction intersecting the longitudinal direction.

Although the above-described embodiment and modified example are structured such that the male terminal 16 is inserted into the female terminal 10, 50, the present invention is not limited to the same, and may be, for example, a structure in which a core wire is directly inserted and connected.

What is claimed is:

1. A female terminal comprising:

a one-piece terminal body consisting of a metallic, polygonal single tube wall having a front metallic open end and a back portion having a wire connecting means for crimping around a wire, said front metallic open end being adapted for receiving a male terminal having an outer surface formed from contiguous flat surfaces that are complementary in shape to an inner polygonal surface of said single tube wall, wherein a plurality of plate spring portions are integrally formed from said single tube wall to extend from different peripheral positions of an axial direction end portion of the single tube wall, the plate spring portions being supported at both ends of said tube wall and contacting the male terminal while elastically deforming independently of one another, and wherein each of said plate spring portions is smoothly curved inwardly toward a central axis of said single tube wall and makes area contact between a smooth inner surface at a substantially center position of the plate spring portions and said complementary flat surfaces of said male terminal at a substantially a same distance along an axial direction of said single tube wall, and wherein each of said plate spring portions has a uniform width along said central axis.

2. The female terminal of claim 1, wherein three or more of the plate spring portions are provided.

3. The female terminal of claim 1, wherein the female terminal body is structured by bending, in a tube shape, a substantially flat-plate-shaped member having a plurality of parallel slits, such that longitudinal directions of the slits coincide with the axial direction.

4. The female terminal of claim 1, wherein the female terminal is structured by bending in a tube shape, a single substantially flat-plate-shaped member having a plurality of parallel slits, such that longitudinal directions of the slits coincide with the axial direction.

5. The female terminal of claim 3, wherein the single tube wall has a shape of a substantially square tube with four plate spring portions.

6. The female terminal of claim 4, wherein the substantially square tube has no more than four plate spring portions.

7. The female terminal of claim 1, wherein the plate spring portions are provided so as to, in natural states, protrude toward an axis so as to not jut-out from a region of an outer configuration of the single tube wall or from a region of an outer configuration of portions of the wall portions other than the plate spring portions, when viewed from the axial direction in a state in which the male terminal is inserted.

* * * * *